US005391469A

United States Patent [19]

Dickerson

[11] Patent Number: 5,391,469

[45] Date of Patent: Feb. 21, 1995

[54] RADIOGRAPHIC ELEMENTS EXHIBITING REDUCED PRESSURE INDUCED VARIANCES IN SENSITIVITY

[75] Inventor: Robert E. Dickerson, Rochester, N.Y.

[73] Assignee: Eastman Kodak Company, Rochester, N.Y.

[21] Appl. No.: 143,673

[22] Filed: Oct. 27, 1993

[51] Int. Cl.[6] ..... G03C 1/46

[52] U.S. Cl. ..... 430/506; 430/502; 430/567; 430/139; 430/966; 430/571; 430/509

[58] Field of Search ..... 430/502, 567, 139, 966, 430/571, 506, 509

[56] References Cited

U.S. PATENT DOCUMENTS

| | | | |
|---|---|---|---|
| 4,414,304 | 11/1983 | Dickerson | 430/353 |
| 4,425,425 | 1/1984 | Abbott et al. | 430/502 |
| B1 4,425,426 | 8/1988 | Abbott et al. | 430/502 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,865,964 | 9/1989 | Newmiller | 430/567 |
| 5,041,364 | 8/1991 | Dickerson et al. | 430/502 |
| 5,061,609 | 10/1991 | Piggin et al. | 430/567 |
| 5,132,203 | 7/1992 | Bell et al. | 430/567 |
| 5,183,727 | 2/1993 | Schmittou et al. | 430/567 |
| 5,268,251 | 12/1993 | Sakuma | 430/139 |

*Primary Examiner*—Thomas R. Neville
*Attorney, Agent, or Firm*—Carl O. Thomas

[57] ABSTRACT

Radiographic elements are disclosed each containing a support and, coated on the support, at least two high tabularity tabular grain emulsions. The tabular grains coated on the support exhibit a face centered cubic crystal lattice structure formed by silver bromide with a selected portion of the tabular grains additionally containing iodide substantially uniformly distributed through the crystal lattice structure in an overall concentration of at least 0.5 mole percent with the iodide concentration at any one grain site being less than 5 mole percent. The proportion of the tabular grains selected to contain iodide as well as the distribution of iodide within the tabular grains results in a reduction in pressure induced variance of radiographic imaging response as a function of applied pressure, such as that inadvertently applied during film handling and processing.

7 Claims, 1 Drawing Sheet

RADIOGRAPHIC ELEMENTS EXHIBITING REDUCED PRESSURE INDUCED VARIANCES IN SENSITIVITY

FIELD OF THE INVENTION

The invention is directed to an improvement in radiographic elements containing tabular grain emulsions.

BACKGROUND

The radiographic and photographic advantages of tabular grain emulsions exhibiting high tabularity were first generally appreciated in the early 1980's.

Tabular grain emulsions are those emulsions in which tabular grains account for greater than 50 percent of total grain projected area. Tabular grains are those that contain two parallel major faces that are clearly larger than any remaining face.

Tabular grain emulsions recognized to be advantageous were initially characterized in terms of their average aspect ratios, where aspect ratio is defined by the following relationship: (I)

$$ECD \div t = AR$$

where

AR represent aspect ratio;

ECD represents tabular grain equivalent circular diameter; and t represents tabular grain thickness.

The average aspect ratio ($AR_{av.}$) of a tabular grain emulsion can be determined as the average of the tabular grain aspect ratios or, more easily, as the quotient of the average ECD ($ECD_{av.}$) and average t ($t_{av.}$) of the tabular grains. High aspect ratio tabular grain emulsions are those in which $AR_{av.}$ is $>8$. Intermediate aspect ratio tabular grain emulsions are those in which $AR_{av.}$ is in the range of from 5 to 8.

An alternative characterization of tabular grain emulsions is in terms of tabularity (T). High tabularity tabular grain emulsions are those that satisfy the relationship: (II)

$$T = >25 = ECD_{av.} \div t_{av.}^2 = AR_{av.}/t_{av.}$$

where $AR_{av.}$ is average aspect ratio;

T is tabularity; and $ECD_{av.}$ and $t_{av.}$ are as defined above, but in this instance both are measured in micrometers (μm).

Kofron et al U.S. Pat. No. 4,439,520 disclosed the first chemically and spectrally sensitized high aspect ratio and high tabularity tabular grain emulsions. Wilgus et al U.S. Pat. No. 4,434,226 reported the preparation of high aspect ratio and high tabularity silver iodobromide tabular grain emulsions with the iodide substantially uniformly distributed within the grains. (All references to mixed halide grains identify halide in an ascending order of halide concentrations.) Solberg et al U.S. Pat. No. 4,433,048 reported high aspect ratio and high tabularity silver iodobromide containing varied iodide concentrations within the tabular grains.

A variety of photographic advantages were observed, including the following having direct applicability to radiography: improved-speed granularity relationships; a capability of more rapid processing; higher contrast for a given level of grain size dispersity; and less image variance as a function of processing time and/or temperature variances.

Concurrently Abbott et al U.S. Pat. Nos. 4,425,425 and 4,425,426 reported reduced crossover in double-coated (Dupltized TM) radiographic elements containing spectrally sensitized high tabularity tabular grain emulsions.

Also concurrently, Dickerson U.S. Pat. No. 4,414,304 reported thin ($t \leqq 0.2$ μm) tabular grain emulsions to exhibit both increased covering power and reduced variance in covering power as a function of the degree of forehardening. This addressed a long standing need in radiography, since the practice in the art prior to this discovery was to forego full forehardening of radiographic elements to avoid excessive loss of covering power, necessitating the completion of hardening during processing after imagewise exposure.

Because of their significant and multiple performance advantages, high tabularity tabular grain emulsions of the silver bromide and iodobromide compositions conventionally employed in radiography were promptly incorporated into commercial radiographic elements.

While high aspect ratio and high tabularity silver bromide and iodobromide emulsions have advanced the state of the art in almost every grain related parameter of significance in silver halide radiography, one area of concern has been the susceptibility of these emulsions to vary their imaging response as a function of the application of localized pressure to the grains. These are observed as localized variations of density (hereinafter referred to as pressure marks) superimposed upon the image information. For example, medical radiographic films are generally coated in large film sizes (e.g., up to 40 cm×40 cm) to obtain full size images of large body portions, such as the thoracic (chest) cavity. These radiographic films require increased care during manufacturing operations, such as cutting to size and packaging, to avoid pressure marking. Unfortunately, the user, the X-ray lab technician, does not always appreciate or implement increased care in handling. Pressure marks can be generated by manual or equipment handling of the film. Pressure marks can be produced by kinking caused by holding a large film sheet by one edge or corner. Kink marks appear as crescent shape pressure marks. Automatic film loaders and exposure devices have been observed to produce pressure marks attributable to misaligned guide pins and rollers applying excessive pressure to the film. Pressure marks are objectionable in all radiographic imaging applications, and are particularly objectionable in medical diagnostic applications, since pressure marks can be mistaken for or obscure pathology features in the radiographic image.

SUMMARY OF THE INVENTION

The present invention is directed to radiographic elements capable of providing the known advantages of radiographic elements containing high tabularity tabular grain emulsions while exhibiting reduced optical density variance as a function of locally applied pressure. This is achieved by limiting iodide incorporation to a selected fraction of the total tabular grain population and by further selecting the level and distribution of iodide within the selected fraction of the tabular grains.

In one aspect this invention is directed to a radiographic element comprised of a support and, coated on the support, at least two tabular grain emulsions in which greater than 50 percent of total grain projected area is accounted for by tabular grains of high tabularity satisfying the relationship:

$$ECD_{av.} \div t_{av.}^2 > 25$$

where $ECD_{av.}$ is tabular grain average equivalent circular diameter in micrometers (μm) and $t_{av.}$ is tabular grain average thickness in μm.

The tabular grains coated on the support exhibit a face centered cubic crystal lattice structure formed by silver bromide with a selected portion of said tabular grains, ranging from 25 to 75 percent, based on total tabular grain silver, additionally containing iodide distributed through the crystal lattice structure in an overall concentration of at least 0.5 mole percent, based on silver in the tabular grains of the selected portion, with iodide concentrations at any one site within the tabular grains being less than 5 mole percent.

DESCRIPTION OF PREFERRED EMBODIMENTS

Figure 1:
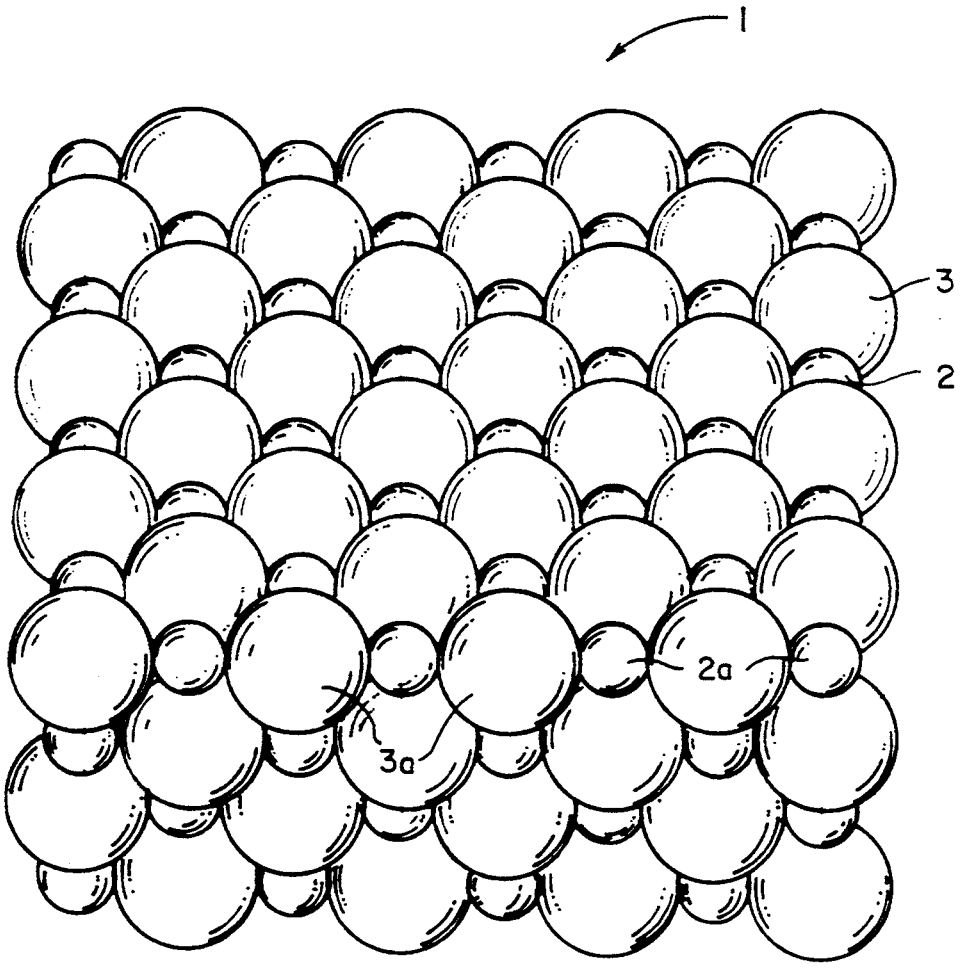
FIG. 1 is a schematic view of a silver bromide crystal structure with the upper layer of ions lying in a {100} crystal plane.

The radiographic elements of the present invention are comprised of a support and two or more tabular grain emulsions each coated on one or both major faces of the support. To realize the known performance advantages of tabular grain emulsions, greater than 50 percent of total grain projected area of each of at least two emulsions is accounted for by high tabularity tabular grains satisfying relationship (II) set out above.

The tabular grains are chosen to exhibit a face centered cubic crystal lattice structure formed by silver bromide. In FIG. 1 four lattice planes of a crystal structure 1 of silver ions 2 and bromide ions 3 is shown, wherein the upper layer of ions lies in a {100} crystal plane. The nearest ions in the upper {100} crystal plane and the visible ions in the three underlying {100} crystal planes together form a {100} crystal plane that is oriented perpendicular to the {100} crystal plane formed by the upper layer of ions. The silver ions 2*a* and bromide ions 3*a* lie in both of these intersecting {100} crystal planes. In the interior of the crystal structure each silver ion lies next adjacent six bromide ions and each bromide ion lies next adjacent six silver ions. Although the drawing schematically depicts each ion as a sphere, relative sizes of the spheres 2 and 3 correspond to the relative diameters of the ions. Note that the silver ions are much smaller than the bromide ions, even though silver is a heavier element than bromine. This relationship results for the silver ion being deprived of its valence electron shell. All silver bromide grains exhibit a face centered cubic crystal lattice structure regardless of the shape of the grain.

In silver bromide emulsions all of the halide ions within the face centered cubic crystal lattice (rock salt) structure of the grains are bromide ions. High tabularity tabular grain silver bromide emulsions are commonly employed in radiographic elements, even though these elements are susceptible to pressure marks.

In a common alternative tabular grain formulation a portion of the bromide ions in the face centered cubic crystal lattice structure are replaced by iodide ions, forming a silver iodobromide grain structure. Since iodine occupies the 5th period of the Periodic Table of Elements whereas bromine is a 4th period element, the iodide ions are much larger than the bromide ions and create distortions in the crystal lattice structure when present. Nevertheless, very high concentrations of iodide ions can be accommodated in the face centered cubic crystal lattice structure, ranging up to 40 mole percent or higher, based on silver, depending upon the conditions chosen for grain precipitation. Attempts to force higher levels of iodide ions into the face centered cubic silver bromide crystal structure results in the formation of a separate high (>90 mole percent, based on silver) iodide silver halide phase. Phase separation is attributable to the fact that silver iodide itself requires formation under 3 to 4 kbar of pressure to form a silver bromide like face centered cubic crystal structure, and the crystal structure is not stable at or near ambient pressure. Under the ambient pressure conditions used to prepare radiographic and photographic silver halide emulsions silver iodide can only be prepared with a zinc-blend type (γ phase) or hexagonal wurtzite type (β phase) crystal structure. Radiographic elements containing high tabularity silver iodobromide tabular grain emulsions also exhibit a high susceptibility to pressure marks.

It has been discovered quite unexpectedly that pressure marks in exposed and developed radiographic elements can be reduced by proper management of iodide in the high tabularity tabular grain emulsions in which the tabular grains have a silver bromide cubic crystal lattice structure. In the practice of the present invention it is possible to reduce pressure marks as compared to those exhibited by comparable high tabularity tabular grain emulsions of either a silver bromide or a silver iodobromide tabular grain composition.

To accomplish this a portion of the tabular grains exhibiting a face centered cubic crystal lattice structure of the high tabularity emulsions coated on the support must be internally free of iodide (i.e., must be silver bromide) while a remaining portion of these tabular grains must internally contain iodide. It is generally preferred that from 25 to 75 percent of the tabular grains of the high tabularity emulsions internally contain iodide. Most preferably from 25 to 50 percent of the tabular grains of the high tabularity emulsions internally contain iodide. These percentages are based on the total silver present in the tabular grains. That is to say, tabular grains accounting for from preferably 25 to 75 percent (most preferably 25 to 50 percent) of total silver in the referenced tabular grain population are contemplated to contain iodide. The referenced grain population is made up of the tabular grains of the two or more high tabularity tabular grain emulsions coated on the support. In order to incorporate iodide ions internally within a portion of the tabular grains while the remaining tabular grains remain free of iodide ion it is, of course, necessary to undertake a minimum of at least two separate emulsions precipitation.

To achieve the advantages of the invention it is not only essential that internally incorporated iodide be segregated to a selected portion of the tabular grains of the high tabularity emulsions, it is also essential that the iodide distribution within the selected portion of the tabular grains conform to identified concentration and distribution requirements. The selected portion of the tabular grains contain an average overall iodide concentration of at least 0.5 mole percent iodide, based on the total silver of these tabular grains. In a preferred form of the invention the selected portion of the tabular grains contains from about 1 to 3 mole percent iodide, based on their total silver.

In addition to maintaining an overall iodide level of at least 0.5 mole percent in the selected portion of the tabular grains, it is essential that the iodide be distributed within the tabular grains. Stated another way, the highest identifiable local concentration of iodide ions in the iodide containing tabular grains should be less than 5 mole percent and preferably less than 4 mole percent. It is preferred that the iodide be distributed substantially uniformly throughout the grain structure.

Techniques for identifying local iodide concentrations within tabular grains are well known in the art. A preferred technique is analytical electron microscopy (AEM). Solberg et al U.S. Pat. No. 4,433,048 demonstrates the application of this technique to determining the iodide concentration through the thickness of a tabular grain by addressing a point on a major face of the tabular grain. This technique has also been employed to identify internal iodide bands or shells within tabular grains. Using this procedure for determining the iodide profile across a tabular grain thickness a slice is cut from a tabular grain using a microtome. A sectional surface of the tabular grain slice is then addressed at measured steps to determine the iodide level at each step location. In either procedure, when an electron beam impinges upon the crystal structure at a selected point, a fluorescent emission is stimulated. Each of bromide and iodide fluoresce with a different spectral emission profile. By comparison with fluorescent spectral profiles generated by known compositions, it is possible to determine the amount of both iodide and bromide ion present at the addressed point. The analytical technique is described by J. I. Goldstein, "Introduction to Analytical Electron Microscopy", *Plenum*, New York (1983), 103:203 (1975).

When iodide is omitted entirely, overused, or otherwise not managed in the manner taught above, one or a combination of performance deficiencies are observed. When iodide is omitted or incorporated only at low levels in the high tabularity tabular grain emulsions, pressure marks characteristic of those produced by silver bromide emulsions are observed. When iodide is incorporated in all of the high tabularity tabular grains, relatively high levels of optical density variance as a function of locally applied pressure are still observed, regardless of the concentrations or distributions of iodide chosen. Further, when combinations of high tabularity silver bromide and iodobromide tabular grains within the relative proportions taught are employed, but iodide is not distributed within the tabular grains or exceeds the local maximum levels taught, significant performance deficiencies are observed. High iodide levels, whether locally confined or distributed are known to interfere with commercial requirements of rapid (<90 second) processing. The use of high tabularity tabular grain emulsions with localized as opposed to distributed iodide, as results from abrupt iodide addition (iodide dumping) during precipitation, described by Solberg et al U.S. Pat. No. 4,433,048, blended with tabular grain silver bromide emulsions does not produce the marked reduction in pressure marks achieved by the practice of the invention. In fact, the optical density variance of pressure marks can be increased, depending upon the specific emulsions being blended.

In a simple form a radiographic element constructed according to the invention can take the following form:

| Structure I |
|---|
| High Tabularity Emulsion Layer |
| Support |

In radiographic element Structure I a single emulsion layer is coated on a support. A blend of two or more high tabularity tabular grain emulsions satisfying relationship (II) is coated on the support. The tabular grains, accounting for at least 50 percent of total grain projected area, provided by the blended emulsions exhibit a face centered cubic crystal lattice structure formed by silver bromide. From 25 to 75 percent of these tabular grains, based on silver forming these tabular grains, contain iodide ions in a concentration and distribution satisfying the criteria set forth above. In the simplest contemplated form of practicing the invention a single high tabularity silver bromide tabular grain emulsion and a single high tabularity silver iodobromide tabular grain emulsion are blended and coated on the support to form a single emulsion layer. However, more than one tabular grain silver bromide emulsion and/or more than one tabular grain silver iodobromide emulsion can be blended, provided all of the iodobromide grains together satisfy the stated tabularity and tabular grain projected area requirements and all of the bromide grains together satisfy the stated tabularity and tabular grain projected area requirements.

The support can take the form of any convenient conventional radiographic element support. It can be a reflective support, such as a paper or reflective film support, or a transparent film support. For the majority of radiographic applications the support in its preferred form is a blue tinted transparent film support.

It is specifically contemplated to construct dual coated (Duplitized TM) radiographic elements. In a simple form a dual coated radiographic element can take the following form:

| Structure II |
|---|
| High Tabularity Emulsion Layer A |
| Transparent Film Support |
| High Tabularity Emulsion Layer B |

The transparent film support can take the form of any convenient conventional radiographic film support known to be useful in dual coated structures. The film support need not be transparent during imagewise exposure, but must be transparent following processing to allow transmission viewing of radiographic images in both of emulsion layers A and B. Preferably the film retains a blue tint, favored by radiologists, after processing.

In the simplest contemplated form of Structure II (hereinafter referred to as Structure IIA) emulsion layers A and B can each be identical to the single emulsion layer of Structure I.

In an alternative simple form (hereinafter referred to as Structure IIB) emulsion layer A consists of a single high tabularity silver iodobromide tabular grain emulsion layer while emulsion layer B consists of a single high tabularity silver bromide tabular grain emulsion layer. The tabular grains accounting for at least 50 percent of the total grain projected area of each emulsion taken together satisfy criteria set forth above for a single emulsion layer in Structure I and Structure IIA. That is, the tabular grains of the two high tabularity emulsions accounting for at least 50 percent of total grain projected area in each emulsion exhibit a face centered cubic crystal lattice structure formed by silver bromide with a selected portion of the tabular grains, contributed by the silver iodobromide emulsion, ranging from 25 to 75 percent of total silver forming these tabular grains, additionally containing iodide distributed through the crystal lattice structure in an overall concentration of at least 0.5 mole percent, based on silver in the silver iodobromide tabular grains. Further, iodide concentrations at any one site within the silver iodobromide tabular grains are less than 5 mole percent. All of the preferred ranges set out above for blended emulsions are equally applicable to Structure IIB.

It can be readily appreciated that Structure IIA represents the limit of high tabularity tabular grain iodide symmetry on the opposite sides of the support and that Structure IIB represents the limit of high tabularity tabular grain iodide asymmetry on the opposite sides of the support. There are any number of intermediate structures possible that exhibit iodide asymmetry, but to a lesser extent that Structure IIB. For example, by choosing Y to represent the 25 to 75 percent of the high tabularity tabular grains that contain iodide, it can be appreciated that the iodide content of emulsion layers A and B can take the following form:

| Structure IIC |
|---|
| Emulsion Layer A |
| High Tabularity |
| Iodobromide Grain Content = Y−X |
| Transparent Film Support |
| Emulsion Layer B |
| High Tabularity |
| Iodobromide Grain Content = X |

where

Y represents from 25 to 75 percent of total high tabularity tabular grain silver coated on the support and X is a greater than zero, but less than Y.

In still another form, it is possible to coat more than one emulsion layer on one side of the support. In a simple form such a structure can be represented as follows:

| Structure III |
|---|
| High Tabularity Emulsion Layer C |
| High Tabularity Emulsion Layer D |
| Support |

The support can take any convenient conventional form, similarly as the support in Structure I. Emulsion layer C can take the form of any single emulsion layer in Structure IIA, IIB or IIC while emulsion layer D takes the form of the remaining emulsion layer of the corresponding structure.

In additional form, it is possible to coat more than one emulsion layer on each side of the support. In a simple form such a structure can be represented as follows:

| Structure IV |
|---|
| High Tabularity Emulsion Layer E |
| High Tabularity Emulsion Layer F |
| Transparent Film Support |
| High Tabularity Emulsion Layer G |
| High Tabularity Emulsion Layer H |

The support can take any of the forms of the support of Structure II. Emulsion layers E and F form one pair of emulsion layers while emulsion layers G and H form a second pair of emulsion layers. The two pairs of emulsion layers can independently take any of the forms described above for the emulsion layer pair formed by emulsion layers C and D in Structure III. Alternatively, each of emulsion layers E and F can be high tabularity iodobromide tabular grain emulsion layers while each of emulsion layers G and H can be high tabularity bromide tabular grain emulsion layers. In still another form the iodobromide grain content of emulsion layers E and F can collectively satisfy the iodobromide grain content of emulsion layer A in Structure IIC while the emulsion layers G and H can collectively satisfy the iodobromide grain content of emulsion layer B in Structure IIC.

In the structures containing two emulsion layers the silver can be distributed between the emulsion layers in any desired manner, so long as the required iodide containing high tabularity grain distributions are satisfied. In Structure IIA preferably the same amount of silver is preferably coated in emulsion layers A and B, but alternatively the silver can be asymmetrically coated until Structure I is reached as an extreme. In Structure IIB the iodide asymmetry requirements limit silver asymmetry.

The high tabularity tabular grains account for greater than 50 percent of total grain projected area and preferably account for at least 70 percent of total grain projected area. Optimally the high tabularity tabular grains account for at least 90 percent of total grain projected area. As tabular grain emulsion preparation procedures have improved it has become possible to prepare tabular grain emulsions in which substantially all (>97%) of total grain projected area is accounted for by tabular grains, as illustrated by Tsaur et al U.S. Pat. Nos. 4,147,771, 4,147,772, 4,147,773, 5,210,013 and 5,252,453 and Saitou et al U.S. Pat. No. 4,797,354.

$ECD_{av.}$ of the high tabularity tabular grains can range up the highest values useful in radiography, generally accepted to be about 10 μm. For optimum relationships between imaging speed and imaging noise, it is preferred for most applications to maintain $ECD_{av.}$ at values of 5 μm or less. From relationship (II), set out above and here repeated for convenient reference, it is apparent that minimum $ECD_{av.}$ is determined by the requirement of maintaining high (>25) tabularity (T) and by the average thickness ($t_{av.}$) of the tabular grains: (II)

$$T=>25=ECD_{av.}\div t_{av.}^2=AR_{av.}/t_{av.}$$

Although ultrathin ($t_{av.}<0.06$ μm) are known, the use of ultrathin tabular grains in radiographic elements are generally avoided, since user objectionable warm image tones are known to increase with decreasing tabular grain thicknesses. It is therefore preferred that $t_{av.}$ be at least about 0.1 μm. Values of $t_{av.}$ are preferably less than 0.5 μm, most preferably less than 0.3 μm. At $t_{av.}$ of 0.1 it is apparent that T is 500 when $ECD_{av.}$ is 5.0 μm and can range up to 1000 when $ECD_{av.}$ is 10 μm. The average aspect ratios ($AR_{av.}$) of the high tabularity tabular grains are preferably at least moderate (≧5) and preferably high (>8). $AR_{av.}$ values preferably range up to 50, but can range up to 100, or higher.

Although the high tabularity tabular grain emulsions have been discussed above in terms of silver bromide and iodobromide emulsions, it is recognized that silver chloride, like silver bromide, forms a face centered cubic crystal lattice structure. It is therefore possible to accommodate chloride ions within a silver bromide face centered cubic crystal lattice structure. The inclusion of small amounts of chloride ion (up to about 10 mole percent, based on silver) are contemplated to modify tabular grain properties.

The tabular grain emulsions employed in the radiographic elements of the invention are chemically sensitized and, when exposed by intensifying screens, they are usually spectrally sensitized as well. Noble metal (e.g., gold) and middle chalcogen (i.e., sulfur, selenium and tellurium) chemical sensitizers can be used individually or in combination. Conventional chemical sensitizers are disclosed in *Research Disclosure,* Vol. 308, December 1989, Item 308119, Section III, the disclosure of which is here incorporated by reference. *Research Disclosure* is published by Kenneth Mason Publications, Ltd., Dudley House, 12 North St., Emsworth, Hampshire P010 7DQ, England. Spectral sensitizers are disclosed in Section IV, of Item 308119. The conventional practice of employing a soluble iodide salt in combination with the spectral sensitizing dye to enhance adsorption of dye to the surfaces of the silver bromide and iodobromide tabular grains is specifically contemplated.

Other conventional features of preferred emulsion layers of the radiographic elements of the invention are disclosed both in Item 308119, which is directed to silver halide emulsion technology generally, and in *Research Disclosure,* Vol. 184, August 1979, Item 18431, the disclosure of which is directed specifically to radiographic elements. The emulsion grains can be internally doped as disclosed in Item 308119, Section I, sub-section D, and Item 18431, Section I, sub-section C. The emulsions can contain antifoggants and stabilizers, as disclosed in Item 308119, Section VI, and Item 18431, Section II. A general description of vehicles and vehicle extenders and hardeners for the emulsions other processing solution penetrable layers of the radiographic elements are disclosed by Item 308119, Sections IX and X.

The following are representative of high tabularity tabular grain emulsions, including chemically and spectrally sensitized forms, that can be used to prepare the radiographic elements of the invention:

| | |
|---|---|
| Wilgus et al | U.S. Pat. No. 4,434,226; |
| Kofron et al | U.S. Pat. No. 4,439,520; |
| Daubendiek et al | U.S. Pat. No. 4,414,310; |
| Maskasky | U.S. Pat. No. 4,713,320; |
| Tsaur et al | U.S. Pat. No. 4,147,771; |
| Tsaur et al | U.S. Pat. No. 4,147,772; |
| Tsaur et al | U.S. Pat. No. 4,147,773; |
| Saitou et al | U.S. Pat. No. 4,797,354; |
| Tsaur et al | U.S. Pat. No. 5,210,013. |

The radiographic elements of this invention preferably contain additional conventional features, such as protective layers overlying the emulsion layer and undercoat layers coated between the support and the emulsion layer. When the emulsion layer is coated on only one face of the support, an antihalation layer is preferably coated on the reverse side of the support or between the emulsion layer and the support. When emulsion layers are coated on opposite faces of the support and intensifying screens are employed for exposure, it is conventional practice to coat an underlayer between each emulsion layer and the support to reduce crossover. *Research Disclosure,* Item 18431, discloses in Section III antistatic agents and layers, in Section IV overcoat layers, and in Section V cross-over exposure control features. Descriptions of preferred radiographic element constructions, their exposure and processing are contained in the following patents, the disclosures of which are here incorporated by reference:

| | |
|---|---|
| Abbott et al | U.S. Pat. No. 4,425,425; |
| Abbott et al | U.S. Pat. No. 4,425,426; |
| Dickerson et al | U.S. Pat. No. 4,414,304; |
| Kelly et al | U.S. Pat. No. 4,803,150; |
| Kelly et al | U.S. Pat. No. 4,900,652; |
| Dickerson et al | U.S. Pat. No. 4,994,355; |
| Bunch et al | U.S. Pat. No. 5,021,327; |
| Childers et al | U.S. Pat. No. 5,041,364; |
| Dickerson et al | U.S. Pat. No. 5,108,881; |
| Tsaur et al | U.S. Pat. No. 5,252,453. |

EXAMPLES

The invention can be better appreciated by reference to the following specific embodiments:

Emulsion A

A silver iodobromide tabular grain emulsion was prepared containing 3 mole percent iodide uniformly distributed through the tabular grains. The tabular grains in the emulsion accounted for greater than 90 percent of total grain projected area. The tabular grains exhibited an average equivalent circular diameter of 2.5 μm and an average thickness of 0.13 μm. The emulsion exhibited a tabularity of 147.

The emulsion was gold, sulfur and selenium sensitized and spectrally sensitized to the green portion of the spectrum with 400 mg/Ag mole of the green absorbing carbocyanine spectral sensitizing dye anhydro-5,5-dichloro-9-ethyl-3,3'-bis(3-sulfopropyl)-oxacarbocyanine hydroxide and 400 mg/Ag potassium iodide to enhance dye adsorption.

Emulsion B

A silver bromide tabular grain emulsion was prepared in which the tabular grains accounted for greater than 90 percent of total grain projected area. The tabular grains exhibited an average equivalent circular diameter of 2.0 μm and an average thickness of 0.13 μm. The emulsion exhibited a tabularity 118. The same chemical and spectral sensitization was employed as described for Emulsion A.

Radiographic Elements

Four radiographic films were constructed as follows:

| |
|---|
| High Tabularity Emulsion B |
| Transparent Film Support |
| High Tabularity Emulsion B |
| Control Film C-1 |
| High Tabularity Emulsion A |
| Transparent Film Support |

-continued

| |
|---|
| High Tabularity Emulsion A |
| Control Film C-2 |
| High Tabularity Emulsion A + B (1:1) |
| Transparent Film Support |
| High Tabularity Emulsion A + B (1:1) |
| Example Film E-3 |
| High Tabularity Emulsion A |
| Transparent Film Support |
| High Tabularity Emulsion B |
| Example Film E-4 |

Each of the emulsion layers were coated with 22.4 mg/dm$^2$ Ag and 31.2 mg/dm$^2$ gelatin. In Film E-3 each emulsion layer contained an equal amount of Emulsion A and Emulsion B, based on silver. Each emulsion layer was overcoated with an interlayer and an outerprotective layer containing together 3.6 mg/dm$^2$ gelatin.

Pressure Induced Density Variance Testing

Before exposure each radiographic element was subjected to the application of pressure by weighting a roller drawn across the film to provide a pressure of 10,000 psi (68,950 kPa). Following the local application of pressure each film was exposed through a step tablet oriented so that the areas of applied pressure extended through all steps. A simulated green emitting intensifying screen exposure was provided, and each film was processed as described in Example 1 of Kelly et al U.S. Pat. No. 4,900,652.

Following processing the optical density of the film was measured at each level of exposure, both in area to which pressure was applied and in the area to which pressure was not applied. The difference between the two densities was then recorded as optical density variance. The densities of the areas to which pressure was not applied used as reference densities. The results are set out in Table I below:

TABLE I

| Reference | Pressure Induced Density Variance | | | |
|---|---|---|---|---|
| Density | C-1 | C-2 | E-3 | E-4 |
| 0 | 0.17 | 0.04 | 0.06 | 0.10 |
| 0.50 | 0.13 | 0.02 | 0.06 | 0.08 |
| 1.00 | 0.18 | 0.12 | 0.03 | 0 |
| 1.50 | 0.15 | 0.23 | 0.12 | 0.04 |
| Average | 0.16 | 0.10 | 0.07 | 0.06 |

From Table I it is apparent that applied pressure produces smaller differences in density in the radiographic elements of the invention at most reference density levels than in the comparison radiographic elements that contain only a silver bromide or silver iodobromide tabular grain emulsion. Further, the average pressure induced density variance observed in the radiographic elements of the invention over the reference density range of from 0 to 1.50 is significantly lower than in the comparison radiographic elements.

The invention has been described in detail with particular reference to preferred embodiments thereof, but it will be understood that variations and modifications can be effected within the spirit and scope of the invention.

What is claimed is:

1. A radiographic element comprised of
a support and,
coated on the support, a blend of at least two tabular grain emulsions in each of which greater than 50 percent of total grain projected area is accounted for by tabular grains of high tabularity satisfying the relationship:

$$ECD_{av.} \div t_{av.}^2 > 25$$

where
$ECD_{av.}$ is tabular grain average equivalent circular diameter in micrometers (μm) and
$t_{av.}$ is tabular grain average thickness in μm, said tabular grains coated on the support exhibiting a face centered cubic crystal lattice structure formed by silver bromide with a selected portion of said tabular grains, ranging from 25 to 75 percent, based on total tabular grain silver, additionally containing iodide distributed through the crystal lattice structure in an overall concentration of at least 0.5 mole percent, based on silver in the tabular grains of the selected portion, with iodide concentrations at any one site within the tabular grains being less than 4 mole percent.

2. A radiographic element according to claim 1 wherein greater than 50 percent of total grain projected area is accounted for by tabular grains of high tabularity satisfying the relationship:

$$ECD_{av.} \div t_{av.}^2 = >25 \text{ to } 1000.$$

3. A radiographic element according to claim 2 wherein greater than 50 percent of total grain projected area is accounted for by tabular grains of high tabularity satisfying the relationship:

$$ECD_{av.} \div t_{av.}^2 = 50 \text{ to } 500.$$

4. A radiographic element according to claim 1 wherein said tabular grains of said selected portion contain from 1 to 3 mole percent iodide, based on silver.

5. A radiographic element according to claim 1 wherein said selected portion of said tabular grains account for from 25 to 50 percent of total tabular grain silver.

6. A radiographic element comprised of
a transparent film support and,
coated on each of two opposite major faces of the support, at least two tabular grain emulsions in each of which greater than 50 percent of total grain projected area is accounted for by tabular grains of high tabularity satisfying the relationship:

$$ECD_{av.} \div t_{av.}^2 > 25$$

where
$ECD_{av.}$ is tabular grain average equivalent circular diameter in micrometers (μm) and
$t_{av.}$ is tabular grain average thickness in μm, said tabular grains coated on the opposite faces of the support exhibiting a face centered cubic crystal lattice structure formed by silver bromide with a selected portion of said tabular grains, coated on only one major face of the support, ranging from 25 to 75 percent, based on total tabular grain silver, additionally containing iodide distributed through the crystal lattice structure in an overall concentration of at least 0.5 mole percent, based on silver in the tabular grains of the selected portion, with iodide concentrations at any one site within the tabular grains being less than 4 mole percent.

7. A radiographic element according to claim 6 wherein said tabular grains other than said selected portion are coated on only one major face of the support.

* * * * *